US008556258B2

(12) United States Patent
Mizubata et al.

(10) Patent No.: US 8,556,258 B2
(45) Date of Patent: Oct. 15, 2013

(54) SHEET STORAGE APPARATUS AND IMAGE FORMATION SYSTEM USING THE APPARATUS

(71) Applicant: Nisca Corporation, Yamanashi (JP)

(72) Inventors: Tsuyoshi Mizubata, Tokyo (JP); Naoya Nakayama, Tokyo (JP); Daiki Komiyama, Yamanashi (JP); Hisashi Osada, Yamanashi (JP); Kenji Yoshida, Yamanashi (JP); Eiji Fukasawa, Yamanashi (JP); Kazunori Hatakawa, Yamanashi (JP)

(73) Assignee: Nisca Corporation, Minamikoma-Gun, Yamanashi (JP)

( * ) Notice: Subject to any disclaimer, the term of this patent is extended or adjusted under 35 U.S.C. 154(b) by 0 days.

(21) Appl. No.: 13/633,492

(22) Filed: Oct. 2, 2012

(65) Prior Publication Data

US 2013/0140765 A1 Jun. 6, 2013

(30) Foreign Application Priority Data

Oct. 7, 2011 (JP) ..... 2011-223041

(51) Int. Cl.
*B65H 31/34* (2006.01)
*B65H 31/36* (2006.01)

(52) U.S. Cl.
USPC ..... 271/221; 271/220; 270/58.07; 270/58.08; 270/58.12; 270/58.17

(58) Field of Classification Search
USPC ..... 271/221, 220, 58.08, 58.11, 58.12, 271/58.17, 58.27
See application file for complete search history.

(56) References Cited

U.S. PATENT DOCUMENTS

| | | | | |
|---|---|---|---|---|
| 4,358,197 | A * | 11/1982 | Kukucka et al. | 399/19 |
| 5,014,977 | A * | 5/1991 | Moore et al. | 271/221 |
| 5,120,047 | A * | 6/1992 | Mandel et al. | 271/220 |
| 7,461,837 | B2 * | 12/2008 | Saito et al. | 270/58.07 |
| 7,850,161 | B2 * | 12/2010 | Fukatsu et al. | 270/58.12 |
| 7,866,649 | B2 * | 1/2011 | Saito et al. | 270/58.12 |
| 8,454,010 | B2 * | 6/2013 | Saito et al. | 271/221 |

FOREIGN PATENT DOCUMENTS

| | | |
|---|---|---|
| JP | 2002-265117 | 9/2002 |
| JP | 2007-145604 | 6/2007 |
| JP | 2011-068465 | 4/2011 |

* cited by examiner

*Primary Examiner* — Luis A Gonzalez
(74) *Attorney, Agent, or Firm* — Manabu Kanesaka

(57) ABSTRACT

To provide a sheet storage apparatus for enabling a sheet to be aligned so that the length-direction position and width-direction position of the sheet coincide with correct reference positions in positioning and storing the sheet in a predetermined position on a tray, it is configured that a paper feed rotating member in a center portion of a sheet that is carried out onto the tray and a paper-pressing guide in the side portion are disposed swingably up and down in the sheet load direction, and that the paper-pressing guide moves upward integrally with the paper feed rotating member floating a predetermined amount or more from the sheet top surface on the tray corresponding to a curl of the sheet.

8 Claims, 9 Drawing Sheets

SHEET STORAGE APPARATUS AND IMAGE FORMATION SYSTEM USING THE APPARATUS

CROSS-REFERENCES TO RELATED APPLICATIONS

The present application claims priority from Japanese Patent Application No. 2011-223041, filed Oct. 7, 2011, the disclosure of which is hereby incorporated by reference herein in its entirety.

TECHNICAL FIELD

The present invention relates to a sheet storage apparatus for loading sheets discharged sequentially on a tray, and more particularly, to improvements in a storage mechanism for enabling sheets which are stacked and stored in a layered manner to be aligned neatly in a predetermined position.

Generally, in this kind of apparatus, a placement tray is disposed by forming a level difference from a sheet discharge outlet, and sheets are dropped on the tray from the sheet discharge outlet, and loaded and stored. A binding processing unit (stapler unit) or the like is disposed on the placement tray to apply post-processing to the sheets with images formed.

Therefore, the placement tray (called the processing tray) is provided with regulating means for positioning the post-processing means and a sheet. Then, the sheet dropped on the tray from the sheet discharge outlet is fed toward the regulating means by a paper feed rotating body, and the sheet end is struck and stopped. Concurrently therewith, the sheet is positioned in the orthogonal direction to sheet discharge, and is collected in a correct position with respect to the post-processing means.

For positioning of the sheet in the width direction, side regulating plates (alignment plates) are provided on the tray to match the sheet side edge with either reference of the center reference or the side reference.

There are a case that a pair of left and right alignment plates are provided to shift and align the width with respect to the center reference and another case of the side reference in which one of the left and right alignment plates is fixed, while approaching and shifting the other alignment plate.

Further, the paper feed rotating body carries the sheet dropped on the tray from the tray sheet discharge outlet to a regulating stopper at the tray front end or the tray rear end. Therefore, as the paper feed rotating body, a roller, caterpillar belt, paddle rotating body or the like is used which moves up and down corresponding to a load amount of sheets.

For example, in Patent Document 1, the processing tray is spaced a level difference apart from the sheet discharge outlet, and a caterpillar belt-shaped rotating body is disposed above the tray so as to hang from a sheet discharge roller. An end portion of the rotating body is configured to engage in an uppermost sheet on the tray and feed the sheet to the regulating stopper side (transport by friction).

When the sheet is struck against the regulating stopper together with the paper feed rotating body of such a structure, a guide plate for pressing the sheet to eliminate the effect of a curl of the sheet is provided so as to hang from above the tray. The guide plate is formed from a plate-shaped piece having elasticity.

Patent Document 2 discloses a similar apparatus. In any of the apparatuses, a sheet is struck against the regulating stopper by the paper feed rotating body on the tray, and then, is width-shifted and moved in the direction orthogonal to the sheet transport direction. At this point, such a problem occurs that the sheet cannot be shifted to a correct position in sheet width-direction shift due to contact of the paper feed rotating body.

Therefore, Patent Document 3 discloses a structure in which the paper feed rotating body (roller) for shifting the sheet to the regulating stopper side is axially supported to be movable in the sheet width direction. The paper feed rotating body is axially supported to be movable in the width direction by a coil spring on the spindle, and is configured to also shift in the same direction when the alignment plates perform operation to hit the sheet side edges.

[Patent Document 1] Japanese Patent Application Publication No. 2002-265117

[Patent Document 2] Japanese Patent Application Publication No.

[Patent Document 3] Japanese Patent Application Publication No. 2011-068465

As described previously, the sheet carried onto the tray is struck against a predetermined regulating member to be positioned, and then, is positioned to a predetermined position in the transport-orthogonal direction (width direction). In this case, conventionally, the sheet is width-shifted and moved by the alignment member from the side edge direction of the sheet with the paper feed rotating body that transports the sheet to the regulating member engaging in the sheet to width-shift.

Therefore, when the alignment member shifts the sheet to the predetermined width-direction position, the paper feed rotating body interferes with the shift of the sheet. There is a problem that the sheet cannot be width-shifted or moved to the predetermined position to be irregular alignment due to action of the paper feed rotating body. This state is shown in FIG. 9, and when the side edge is pressed toward the center by the alignment member with the sheet center portion brought into press-contact with the paper feed rotating body, the sheet bends and becomes deformed without width-shifting.

Therefore, as in Patent Document 3, such a method is attempted that the paper feed rotating body at the center is retracted to above the sheet in width-shifting and moving the sheet side edge. Conventionally, a bracket member for supporting the paper feed rotating body is moved upward with a motor, solenoid or the like. Therefore, the paper feed rotating body is retracted upward by the same amount in any case of sheets tending to bend and deform, and sheets tending to cause wrinkles and damage depending on the material of the sheet.

Hence, in a state in which the paper feed rotating body is retracted upward, the sheet becomes free, and causes misalignment as if to dance due to hit action of the alignment plate. In this case, it is preferable to press a weak sheet by a low pressure, while pressing a sheet tending to curl by a high pressure. In contrast thereto, in the conventional method for forcibly retracting the paper feed rotating body with driving means, it is difficult to apply engagement conditions according to properties of the sheet. FIG. 9 shows this state, where when the paper feed rotating body separates upward from the sheet to be width-shifted, the sheet is in a free state, and the position of the sheet is unstable due to action of the hit force of the alignment plate, and outside wind.

Then, the inventor of the present invention arrived at the idea that it is possible to press a strong sheet strongly, while pressing a weak sheet weakly, for example, by supporting the paper feed rotating body so that engagement conditions of the paper feed rotating body vary according to properties of the sheet.

It is an object of the present invention to provide a sheet storage apparatus for enabling a sheet to be aligned so that the length-direction position and width-direction position of the sheet coincide with correct reference positions in positioning and storing the sheet in a predetermined position on a tray.

Further, it is another object of the invention to provide a sheet storage apparatus for enabling sheets sequentially loaded to be aligned and collected in a proper position with a simplified structure.

SUMMARY OF THE INVENTION

To attain the above-mentioned objects, the present invention is characterized in that a paper feed rotating member in a center portion of a sheet that is carried out onto the tray and a paper-pressing guide in the side portion are disposed swingably up and down in the sheet load direction, and that the paper-pressing guide moves up integrally with the paper feed rotating member floating a predetermined amount or more from the sheet top surface on the tray corresponding to a curl of the sheet.

In the invention, when the paper-pressing guide for pressing the side portion of the sheet carried on the tray floats a predetermined amount or more, the paper feed rotating body for pressing the sheet is configured to integrally move up above the sheet, and therefore, the following effects are produced.

A sheet that is carried on the tray from the sheet discharge outlet is struck against the position regulating member by the paper feed rotating member to be aligned, and is position-aligned in the orthogonal direction by the width-shift alignment member. At this point, when the alignment member shifts the sheet in the orthogonal direction, the paper-pressing guide acts so as to weaken the sheet pressing force of the paper feed rotating body according to the degree of a curl of the sheet. Therefore, it is possible to align the sheet in a correct position, without the paper feed rotating body interfering with the width-direction shift of the sheet.

Further, the structure is structure for providing the paper-pressing guide in the side portion of the paper feed rotating body, and integrally moving the guide up in synchronization with the paper feed rotating body when a rise amount of the paper-pressing guide is a predetermined amount or more, is thus simplified structure and is capable being adopted at low cost.

BRIEF DESCRIPTION OF DRAWINGS

FIG. 1A shows one Embodiment (unit combined configuration) of the image formation system, FIG. 1B shows a different Embodiment (standalone configuration), and FIG. 1C shows another Embodiment;

FIG. 5A shows a state view in which a curl does not occur in a sheet in width-shift alignment, and FIG. 5B is an explanatory view of a state in which a curl occurs in a sheet in width-shift alignment;

FIG. 6A shows a sheet alignment mechanism of a processing tray, and FIG. 6B shows a punch mechanism for punching a filing hole in a sheet;

DETAILED DESCRIPTION OF PREFERRED EMBODIMENTS

Figure 1A:
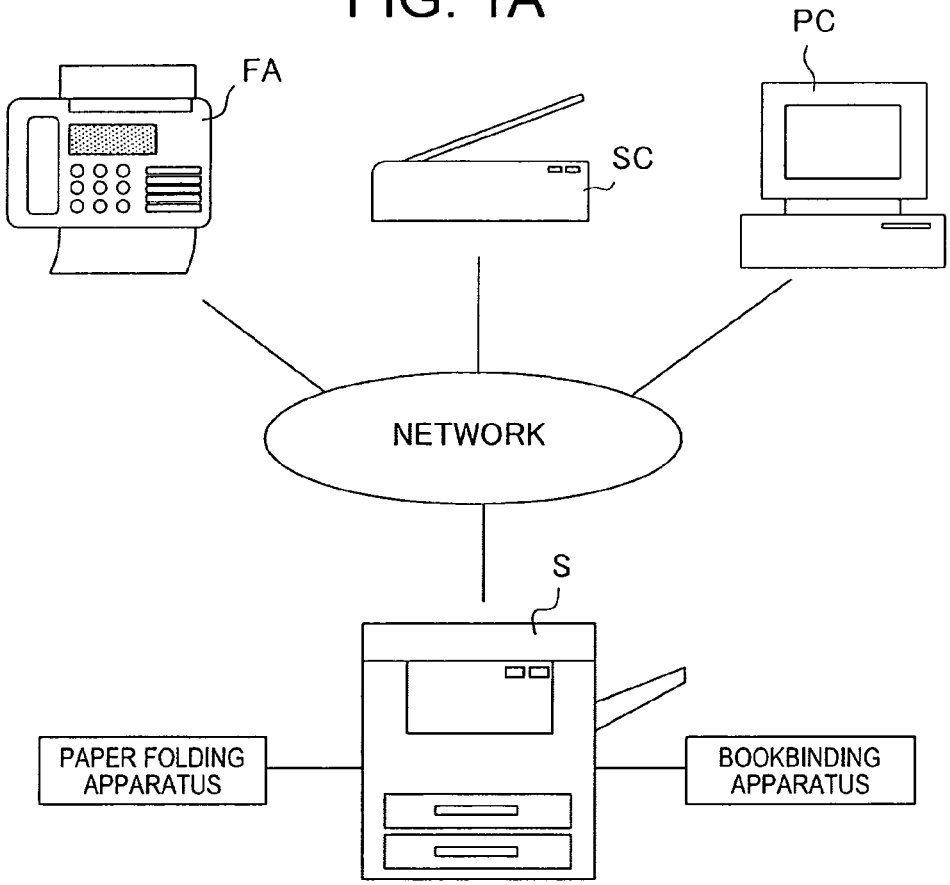
FIGS. 1A-1C show examples of a computer network with an image formation system according to the invention installed, where
Figure 1B:
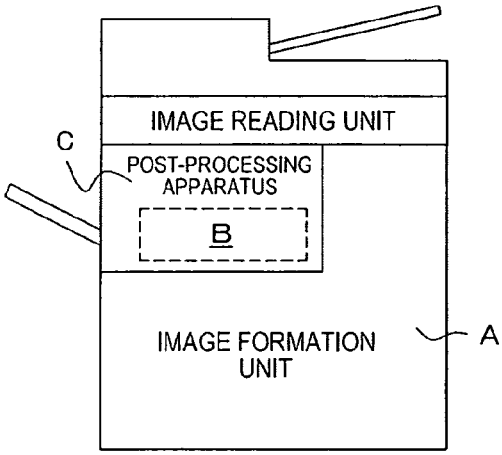
Figure 1C:
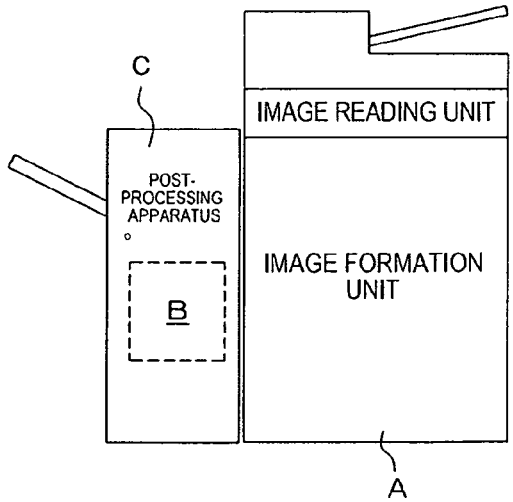

The present invention will specifically be described below based on preferred Embodiments shown in drawings. The invention relates to a sheet storage apparatus B that loads and stores sheets that are sequentially fed, and an image formation system S provided with the apparatus B. FIGS. 1A-1C show the image formation system as an output terminal of a computer network.

The image formation system S is comprised of an image formation apparatus A that forms an image on a sheet, and the sheet storage apparatus B that stores the sheet with the image formed. As shown in FIG. 1B, the image formation system S is comprised of a unit structure in which the image formation apparatus A and the sheet storage apparatus B are mounted in a common apparatus housing.

Alternatively, as shown in FIG. 1C, the system S is comprised of a standalone structure in which the image formation apparatus A and the sheet storage apparatus B are mounted in respective different housings. PC shown in FIG. 1A denotes a computer apparatus, FA denotes a facsimile apparatus, and SC denotes a scanner apparatus.

In addition, the sheet storage apparatus B is configured as a stack apparatus that loads and stores sheets that are sequentially carried out, or a post-processing apparatus that performs post-processing on a sheet that is carried out, and then loads and stores the sheet.

Hereinafter, the invention will specifically be described as the image formation system S for collating and collecting sheets on which images are formed in the image formation apparatus A to perform binding processing, and then, storing the sheets on a stack tray.

[Image Formation System]

Figure 2:
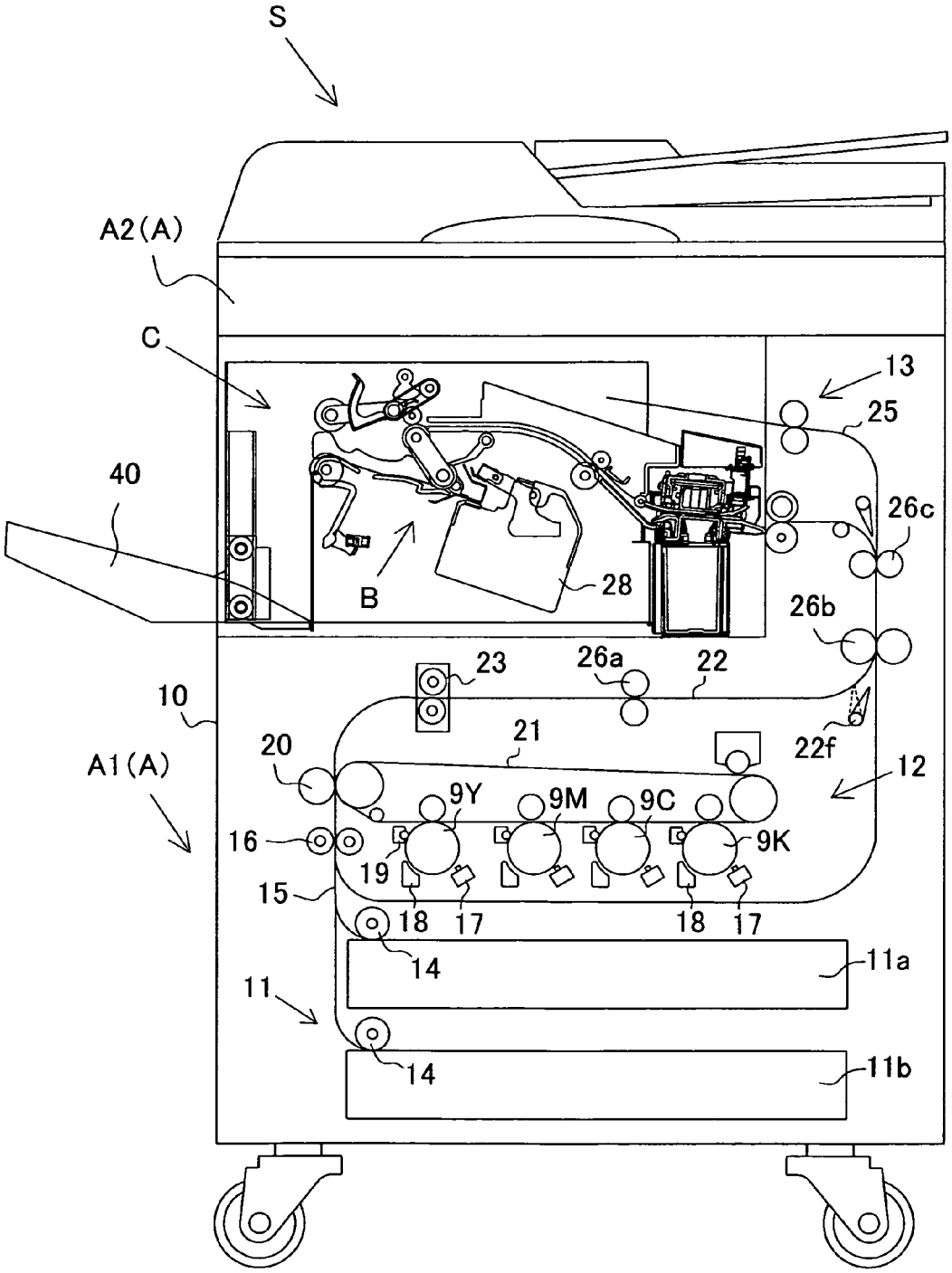
FIG. 2 is an explanatory view of the entire configuration of the image formation system according to the invention.

FIG. 2 shows the image formation system S. This system is comprised of the image formation apparatus A and the post-processing apparatus C, and the sheet storage mechanism (apparatus) B is incorporated into the post-processing apparatus C. Each apparatus is integrally mounted in an apparatus housing 10. Further, the image formation apparatus A is comprised of an image formation unit A1 and an image reading unit A2.

The image formation unit A1 is comprised of a paper feed section 11, image formation section 12 and sheet discharge section 13, and is mounted in the apparatus housing (exterior casing) 10. The paper feed section 11 is comprised of a single or a plurality of paper feed cassettes 11*a*, 11*b*, and each cassette is configured to be able to store sheets of a different size, and is provided with a paper feed roller 14 for feeding out a sheet, and separation means (separation hook, separation roller, etc.) for separating sheets on a sheet-by-sheet basis (not shown). The paper feed cassettes 11*a*, 11*b* are installed in the apparatus housing 10 to be loadable and unloadable.

A sheet fed out of the paper feed section 11 is guided to a paper feed path 15, and this path is provided with a register roller 16 for causing the sheet to temporarily wait. It is possible to provide the paper feed path 15 with a large-capacity cassette to be a configuration for guiding transported sheets to the register roller 16, or to provide the path with a manual tray to manually feed a sheet.

The image formation section 12 is disposed above the paper feed section 11, and forms an image on a sheet sent from the register roller 16. As an image formation mechanism, it is possible to adopt various types of printing mechanisms such as ink jet printing, offset printing, and ink ribbon printing. The image formation section 12 shown in the figure indicates an electrostatic image formation mechanism. Around a photosensitive drum 9 are arranged a printing head 17, developing device 18 and cleaner 19.

The printing head 17 is comprised of an emitter of light beams such as laser emission and LED emission, and forms a latent image on the photosensitive drum. The developing device 18 adds toner ink to the latent image. The toner ink added to the drum surface is transferred to the sheet fed out of the register roller 16 by a charger 20.

The apparatus as shown in the figure indicates a color image formation mechanism, and toner ink formed on YMCK four drums (9Y, 9M, 9C, 9K) is transferred to a transfer belt 21, and image-combined. The image ink transferred to the transfer belt 21 is transferred onto the sheet by the transfer charger 20. In a sheet discharge path 22 provided with the transfer charger 20, a fuser 23 is provided and heats and fuses the image transferred onto the sheet. The sheet discharge path 22 carries out the sheet from the image formation section 12 to a sheet discharge outlet 24 (24*a*, 24*b*).

In addition, the sheet discharge outlet 24*a* indicates a sheet discharge outlet for carrying out a sheet toward the post-processing apparatus (unit) C from the sheet discharge path 22, and the sheet discharge outlet 24*b* shown in the figure indicates a sheet discharge outlet for carrying out a sheet to a switchback path of a circulating path (duplex path) 25, described later.

The apparatus housing 10 is provided with the sheet discharge path 22 for guiding a sheet from the image formation section 12 to the sheet discharge outlet 24. Concurrently therewith, the circulating path (duplex path) 25 is disposed to reverse the side of the sheet fed from the sheet discharge path 22 to feed again to the register roller 16. The sheet discharge path 22 and circulating path 25 form the sheet discharge section 13.

In addition, in the case of an apparatus configuration without the post-processing apparatus C, described later, being provided, a sheet discharge tray (not shown) for loading and storing sheets is disposed on the downstream side of the sheet discharge outlet 24.

In the apparatus of FIG. 2, the image reading unit A2 is disposed above the image formation unit A1. The image reading unit A2 incorporates a platen to place an original image, and a scanner mechanism for irradiating the original on the platen with light to perform photoelectric conversion on the reflected light.

Particularly, in the apparatus of FIG. 2, the image formation section 12, sheet discharge section 13 and image reading unit A2 are disposed upward in this order. Then, the sheet discharge section (post-processing apparatus C, described later) and image reading unit A2 are supported by frame strength of the image formation unit A1.

[In Regard to the Sheet Discharge Section Structure]

As described above, the image formation unit A1 incorporates the paper feed section 11, image formation section 12 above the section 11, and sheet discharge section 13 above the section 12 in the apparatus housing 10 and is comprised thereof, and the image reading unit A2 is disposed above the sheet discharge section 13.

As shown in FIG. 2, in the apparatus housing 10 (hereinafter, referred to as a first housing) of the image formation unit A1, the paper feed section 11, image formation section 12, and sheet discharge section 13 are disposed upward in this order, and the sheet discharge section 13 is formed in a sheet discharge area 13A.

The sheet discharge area 13A is comprised of space formed between the image formation unit A1, and the image reading unit A2 disposed above the unit A1, and a discharged sheet is stored in this portion.

In the sheet discharge section 13, the post-processing apparatus C, described later, is disposed, or a sheet storage tray is disposed. The post-processing apparatus C performs post-processing such as, for example, punching a file hole in the sheet with the image formed, collating and collecting the sheets to perform bookbinding, and stamping.

Further, in the post-processing apparatus C, a stack tray 40 is disposed on the downstream side of a processing tray 35.

The sheet discharge section 13 is configured as described below. In the apparatus housing 10, the sheet discharge area 13A is formed in the sheet discharge section 13, and it is configured to carry out the sheet with the image formed into the area. Further, the image formation section 12 is configured to print on both sides, where a sheet is fed to the register roller 16 from the paper feed section 11, and the sheet with the image formed on its one side is fed again to the register roller 16.

Therefore, the image formation section 12 is provided with the duplex path 25 for reversing the side of the sheet carried out to the sheet discharge section 13 to feed gain to the register roller 16 position. The sheet fed to the sheet discharge path 22 from the image formation section 12 via the fuser 23 is carried to the sheet discharge area 13A from the sheet discharge outlet (second sheet discharge outlet 24*b*). This sheet discharge area 13A is coupled to the duplex path 25, described later.

In the apparatus housing 10, the first sheet discharge outlet 24*a* and second sheet discharge outlet 24*b* are spaced a distance d apart vertically. The first sheet discharge outlet 24*a* positioned upward is connected to a switchback path 25*a*, and the second sheet discharge outlet 24*b* is coupled to a sheet carrying-out path 29 of the post-processing apparatus C. The switchback path 25*a* forms a part of the duplex path 25 for reversing the side of the sheet with the image formed on its one side to guide to the image formation section 12.

Meanwhile, the sheet carrying-out path 29 guides the sheet fed from the second sheet discharge outlet 24*b* to the processing tray 35 for performing post-processing on the sheet. In the path is disposed a punch unit 27 for punching a file hole in the passing sheet.

The duplex path 25 is comprised of the switchback path 25*a* for reversing the transport direction of the sheet, and a U-turn path 25*b* for reversing the side of the sheet fed from the path 25*a*. Further, this path is configured as a path to guide the sheet with the side reversed to the register roller 16 of the image formation section 12.

In the apparatus of FIG. 2, the paper feed section 11 having the paper feed cassettes 11*a*, 11*b* is disposed on the bottom of the exterior casing 10, the image formation section 12 is disposed above the section 11, and the sheet discharge section 13 is disposed above the section 12. In the exterior casing 10, the first sheet discharge outlet 24*a* is disposed in the upper portion, the second sheet discharge outlet 24*b* is disposed in the lower portion, and the path configuration is made so that the first sheet discharge outlet 24*a* is connected to the switchback path 25*a* and that the second sheet discharge outlet 24*b* is connected to the sheet carrying-out path 29.

It is thus configured to guide a sheet to form an image on its one side to the second sheet discharge outlet 24*b* positioned in the lower position, while feeding a sheet to form images on its two sides to the first sheet discharge outlet 24*a* positioned in the upper portion.

The reason is to discharge the sheet of one-side printing from the sheet discharge path 22 configured short in the path length, while carrying out the sheet for two-side printing from the duplex path 25 configured long in the path length. The process path for one-side printing is set to be faster than the process path for two-side printing, and corresponding thereto, the transport velocity for discharging the sheet of one-side printing in the sheet discharge path 22 is designed to be faster than the transport velocity for carrying out the sheet of two-side printing.

[Configuration of the Sheet Discharge Section]

The specific configuration of the sheet discharge section will be described. The sheet with the image transferred by the charger 20 of the image formation section 12 undergoes fusing by the fuser 23, and is guided to the sheet discharge path 22. The sheet discharge path 22 selectively feeds the sheet to the first sheet discharge outlet 24*a* or the second sheet discharge outlet 24*b*. The configuration will be described.

Figure 3:
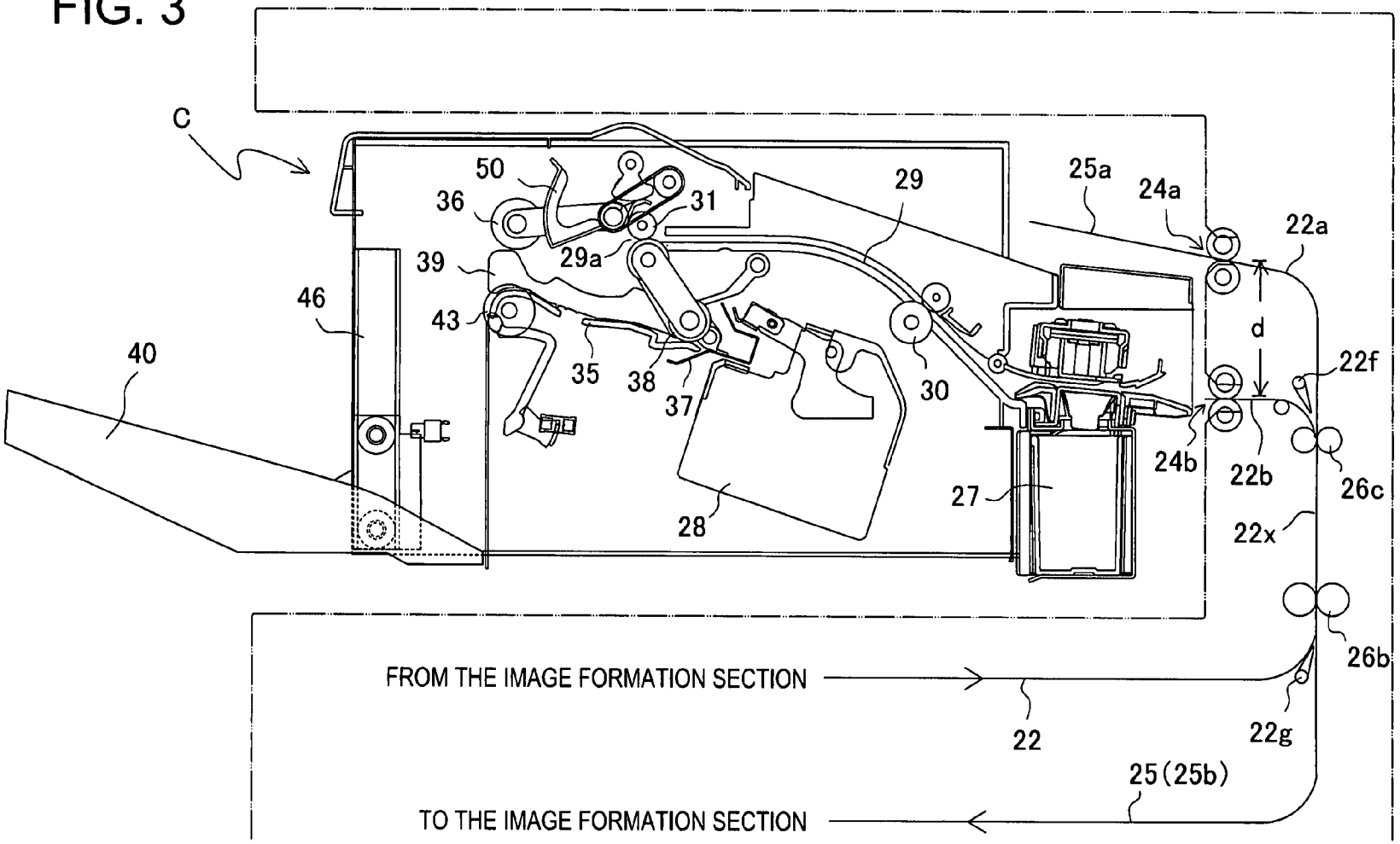
FIG. 3 is an explanatory view of a detailed configuration of a post-processing unit in the system of FIG. 2.

In the structure of FIG. 3, the sheet discharge path 22 for carrying out the sheet from the image formation section 12 extends to two directions of the direction of the first sheet discharge path 22*a* and the direction of the second sheet discharge path 22*b* via path switching means 22*f*.

Then, the first sheet discharge path 22*a* is coupled to the first sheet discharge outlet 24*a*, the sheet discharge outlet 24*a* is coupled to the switchback path 25*a*, and the second sheet discharge path 22*b* is coupled to the second sheet discharge outlet 24*b*. In addition, the first sheet discharge outlet 24*a* and the second sheet discharge outlet 24*b* are spaced the distance d apart vertically.

Concurrently therewith, the sheet discharge path 22 is provided with path switching means 22*g* for guiding the sheet fed backward from the first sheet discharge path 22*a* to the U-turn path 25*b*. In such a path configuration, a shared feed portion 22*x* shown in the figure forms a shared path through which the sheet fed backward from the switchback path 25*a* and the sheet fed toward the first or second sheet discharge path 22*a*, 22*b* pass alternately.

Accordingly, a control section 70 of the image formation apparatus A, described later, needs to control transport timing, at which previous and next sheets are carried to the first and second sheet discharge paths 22*a*, 22*b*, not to overlap each other in the shared feed portion 22*x*. In this case, when the sheet is fed from the first sheet discharge path 22*a* to the switchback path 25*a*, it is suitable to set the condition that the sheet rear end passes through the cross portion (position of the path switching means 22*f*) and enters into the switchback path.

[Post-Processing Apparatus]

For the post-processing apparatus C, FIG. 2 shows the entire configuration, and FIG. 3 shows the enlarged structure of principal part. The post-processing apparatus C performs post-processing on a sheet fed from the image formation apparatus A to store in the stack tray 40. As post-processing means, known are a punch unit that punches a file hole in the sheet, staple unit that binds sheets which are collated and collected, stamp unit that puts a stamp on the sheet, folding processing unit that folds the sheet with the image formed, and the like, which are combined as appropriate and configured according to apparatus specifications.

The apparatus of FIG. 2 incorporates a staple unit 28 that performs binding processing on sheets, and a punch unit 27. The configuration will be described below.

In the Embodiment as shown in FIG. 3, the post-processing apparatus Cis incorporated into the sheet discharge area formed inside the housing of the image formation apparatus A to be built-in. Therefore, the post-processing apparatus C is not provided with an exterior casing (the post-processing apparatus C may be equipped with a different exterior casing from that of the image formation apparatus A.) In this unit frame are disposed the sheet carrying-out path 29, processing tray 35 and stack tray 40.

The sheet carrying-out path 29 has a path configuration continued to the sheet discharge path 22 of the image formation apparatus A, and has a carrying-out exit (hereinafter, referred to as a sheet discharge outlet) 29*a*. The sheet carrying-out path 29 is comprised of a linear path crossing the apparatus housing 10 substantially in the horizontal direction.

On the downstream side of the sheet carrying-out path 29, the processing tray 35 is disposed while forming a level difference from the sheet discharge outlet 29*a*. Further, the punch unit 27 is disposed in an entrance portion of the sheet carrying-out path 29, and punches a file hole in sheets that are sequentially carried in.

Further, in the sheet carrying-out path 29 are disposed path transport means (transport roller) 30 for transporting a sheet to the downstream side and a sheet discharge roller 31 and sheet detection sensor S1 in the vicinity of the sheet discharge outlet 29*a*.

The level difference is formed between the sheet discharge outlet 29*a* and the processing tray 35, and a sheet rear end is dropped from the sheet discharge roller 31 of the sheet discharge outlet 29*a* onto the processing tray to store. In between the sheet discharge roller 31 and the processing tray 35 are disposed a reverse roller 36 that reverses the transport direction of a sheet that is carried on the processing tray, and a take-in roller (alignment rotating body; the same in the following description) 38 that causes the sheet entering onto the processing tray to strike a position regulating stopper 37.

The stack tray 40 is disposed on the downstream side of the processing tray 35, and stores sheets (bunch) subjected to post-processing on the processing tray 35. Described sequentially are a sheet discharge mechanism for discharging a sheet to the processing tray 35, and a stack mechanism for storing sheets subjected to post-processing.

[Sheet Discharge Mechanism]

A sheet that is carried out of the sheet discharge outlet 29*a* is configured to be supported by the processing tray 35 and the stack tray 40 in the shape of a bridge. This is because of making the processing tray 35 small and compact by supporting the sheet front end by the stack tray 40, while supporting the sheet rear end by the processing tray 35. The processing tray 35 may be configured in the shape (dimensions) to place a sheet by itself.

The sheet discharge outlet 29*a* and the processing tray 35 are spaced the level difference apart and thus are disposed at a distance vertically. The level difference is to make a load amount on the processing tray large capacity and ensure arrangement space of a mechanism (the take-in roller 38 and paper-pressing guide 52 described later) for aligning sheets on the processing tray.

Further, the processing tray 35 is configured in the shape for supporting only the sheet rear end portion, instead of the dimension shape for supporting the whole of the sheet. This is because of adopting the structure for bridge-supporting the sheet from the sheet discharge outlet 29*a* at the front end portion by the stack tray 40 and at the rear end portion by the processing tray 35. Therefore, the stack tray 40 moves up and down in the load direction, and the processing tray 35 is fixed to a predetermined position.

In the processing tray 35, the position regulating stopper 37 is disposed in the sheet rear end portion (that may be the sheet front end portion). The staple unit 28 is disposed to perform post-processing on sheets aligned by the position regulating stopper 37.

Further, in the processing tray 35 is disposed sheet side alignment means 39 for width-shifting and aligning a sheet in the sheet-discharge orthogonal direction. The structure can adopt the already known method. For example, a pair of alignment plates are provided on the sides of a sheet, and it is possible to align with respect to the center reference by approaching and shifting the alignment plates to the sheet front end.

Above the processing tray 35, the sheet discharge outlet 29*a* and sheet discharge roller 31 are disposed in the substantially center portion of the tray, and the reverse roller 36 is spaced a distance (distance from the sheet discharge roller) apart in front (on the downstream side) of the sheet discharge outlet 29*a*. Further, the take-in roller 38 is disposed immediately below (that is an approximate position) of the sheet discharge outlet 29*a*.

The reverse roller 36 is required to be disposed on the downstream side of the sheet discharge outlet 29*a*, engage in the uppermost sheet on the processing tray, carry the carried-in sheet to the reverse direction, and be able to wait in a waiting position retracted from the path of the sheet extending from the sheet discharge outlet 29*a* to the processing tray 35.

Therefore, the reverse roller 36 is comprised of a rotating body such as a roller and belt that rotate, and is configured to be able to move up and down between the waiting position above the processing tray and an actuation position for engaging in the sheet on the processing tray.

[Take-in Roller Mechanism]

On the processing tray 35, it is necessary to carry a sheet onto the processing tray by the reverse roller 36, and concurrently therewith, to cause the sheet to strike the predetermined position regulating stopper 37 to position. Therefore, the take-in roller 38 is disposed in the level difference between the sheet discharge roller 31 and the processing tray 35.

The take-in roller 38 comes into contact with the uppermost sheet on the processing tray to carry to the position regulating stopper 37. The take-in roller 38 is comprised of a rotating body such as an endless belt, and presses the uppermost sheet with a certain pressure corresponding to the load amount of sheets on the processing tray.

Therefore, the take-in roller 38 is supported to be swingable to move up and down corresponding to the load amount of sheets on the processing tray. The take-in roller 38 shown in the figure is supported by a bracket 44 axially supported swingably by the rotating shaft 31*x* of the sheet discharge roller (driven roller) 31*b*. The take-in roller 38 is coupled to a driving motor M3 (not shown).

It is also possible to convey a rotating force to the take-in roller 38 from the sheet discharge roller (driven roller) 31*b*, and in the roller shown in the figure, the take-in roller 38 is driven to rotate with the driving motor M3 different from the sheet discharge roller 31*b*.

This is because the take-in roller 38 carries sheets collected on the processing tray to the stack tray 40 side after the post-processing. At this point, it is necessary to rotate the take-in roller 38 in the opposite direction to the rotation direction, and for that, the sheet discharge roller 31*b* needs to be rotated in the sheet-discharge opposite direction.

Therefore, by separately providing a rotation driving motor of the sheet discharge roller 31*b* and the driving motor M3 of the take-in roller 38, during sheet discharge operation for carrying out sheets subjected to the post-processing from the processing tray 35 by the take-in roller 38, it is possible to feed the succeeding sheet onto the processing tray from the sheet discharge outlet 29*a* by the sheet discharge roller 31*b*.

[Kick Mechanism]

In between the sheet discharge outlet 29*a* and the reverse roller 36 are needed a guide mechanism for guiding a sheet from the sheet discharge outlet 29*a* to the reverse roller position, and another guide mechanism for guiding the sheet rear end from the sheet discharge outlet 29*a* to the take-in roller 38.

Particularly, in the sheet discharge mechanism having a large level difference between the sheet discharge outlet 29*a* and the processing tray 35, when the sheet rear end drops onto the processing tray, the sheet is sometimes caught in the periphery of the sheet discharge roller 31 to cause a sheet jam.

Therefore, in the apparatus as shown in the figure, a kick mechanism 50 is disposed between the sheet discharge outlet 29*a* and the reverse roller 36.

[Alignment Mechanism]

Figure 6A:
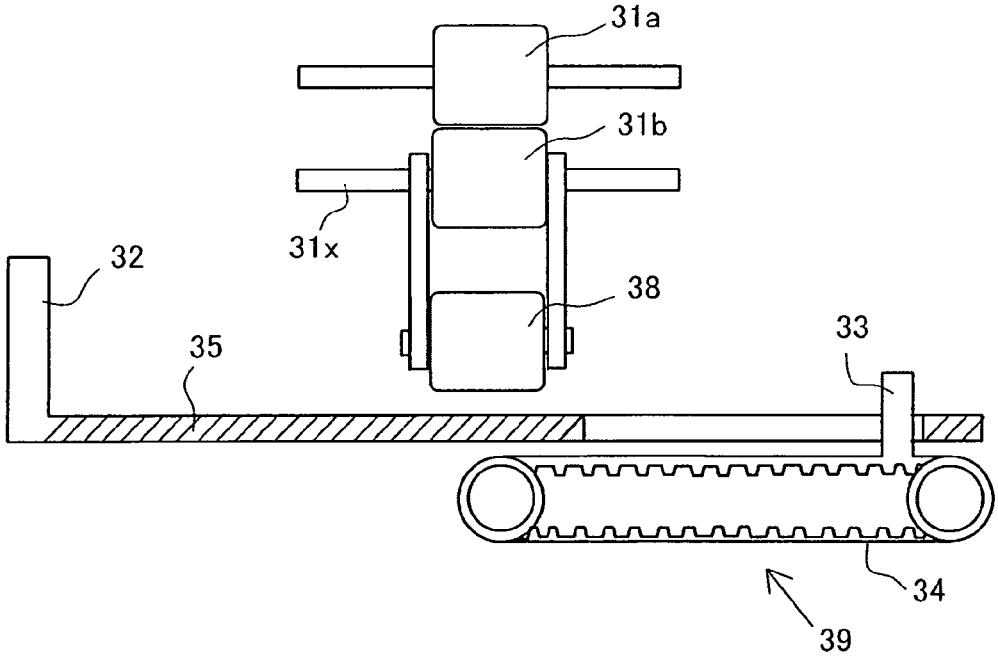
FIGS. 6A and 6B contain principle-part explanatory views in the post-processing apparatus of FIG. 2, where

An alignment mechanism as shown in FIG. 6A will be described. The processing tray 35 is provided with a width-shift alignment mechanism for aligning the width direction of the sheet struck against the position regulating stopper 37 by the take-in roller 38. This mechanism aligns the sheet with respect to the center reference or one side reference.

The one side reference as shown in the figure will be described as an example. A fix regulating surface 32 is provided on one edge side of the sheet. A movable alignment plate 33 is disposed on the opposite side to the fix regulating surface 32 with the take-in roller 38 therebetween, and is configured to be movable in the width direction. The alignment plate 33 is coupled to a timing belt 34 coupled to an alignment motor M, not shown.

By this configuration, when the alignment motor M rotates forward and backward, the timing belt 34 reciprocates by a predetermined stroke, and the alignment plate 33 fixed to the belt approaches and separates from the fix regulating surface 32. The sheet is width-shifted and aligned with reference to the regulating surface 32 by reciprocating shift between the waiting position and the width-shift position.

The control means, described later, controls the alignment motor M and shifts the alignment plate 33 in the waiting position (solid-line position shown in the figure) to the width-shift position (dashed-line position shown in the figure), when a predetermined delay time has elapsed since a detection signal that the sheet rear end is detected by the sheet discharge sensor (sheet detection sensor) S1 described previously After shifting the sheet to the predetermined position, the alignment plate 33 returns to the waiting position.

The take-in roller 38 and reverse roller 36 are disposed on the processing tray. The reverse roller 36 and take-in roller 38 cause the sheet to strike the position regulating stopper 37 to correct the sheet posture in the transport direction.

Before and after the striking alignment of the sheet, the reverse roller 36 waits in the waiting position above the processing tray. Further, upper paper-pressing guides 52 for pressing the sheet are provided on the processing tray.

Figure 4:
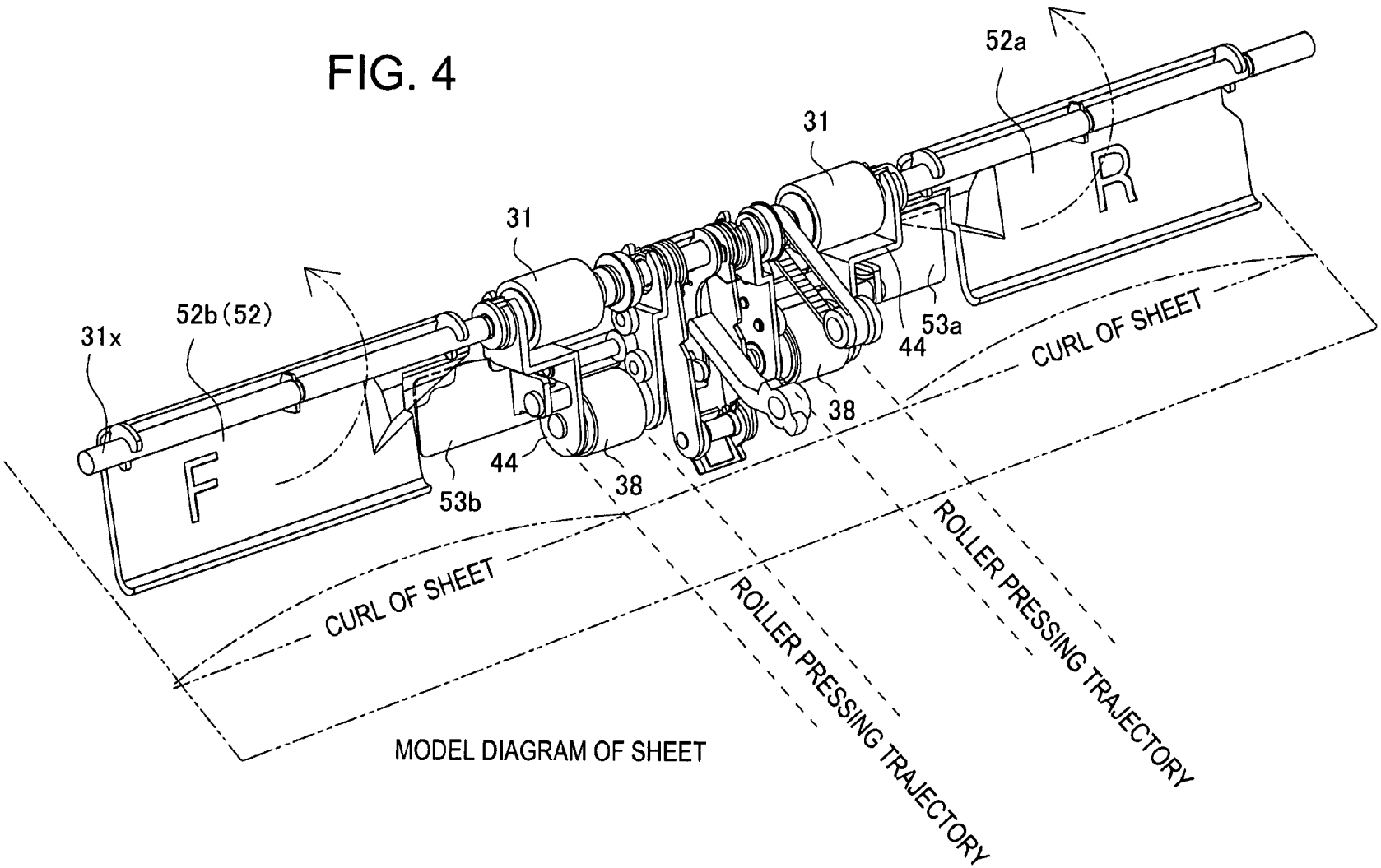
FIG. 4 is an explanatory view of a sheet width-shift mechanism of the apparatus of FIG. 2.

As the paper-pressing guides 52, as shown in FIG. 4, the take-in roller 38 is disposed in the center portion of the sheet on the processing tray, and a pair of left and right paper-pressing guides 52 are disposed to the left and right of the roller. As described previously, in the take-in roller 38, the bracket (roller support member; the same in the following description) 44 is axially supported by the rotating shaft 31*x* common to the sheet discharge roller 31, and the left and right paper-pressing guides 52 are also axially supported by the spindle to be swingable.

There is no inevitability for supporting both members by the same rotating shaft, but by supporting by the common shaft, it is possible to simplify the mechanism.

The take-in roller 38 and paper-pressing guides 52 are axially supported to be swingable up and down separately in a free manner. This is because of moving up and down while following the load amount of sheets and pressing the sheets with a uniform pressure irrespective of the load thickness of sheets. Then, the take-in roller 38 provides the sheet with a transport force, and the left and right guides 52 are to prevent the sheet from rising to deform (curl).

Then, in width-shifting and aligning by the alignment mechanism as described previously, when the take-in roller 38 and paper-pressing guides 53 engage in the sheet top surface so as to press, there is the following defect in shifting the movable alignment plate 33 from the waiting position to the regulating position.

When the sheet end edge is width-shifted and moved by the alignment plate with the sheet center portion pressed and restrained by the take-in roller 38, the sheet significantly curls to deform, and does not shift to the reference position on the opposite side. Then, when the movable alignment plate 33 is retracted, the sheet returns to the original non-aligned state.

As the measures, the apparatus as shown in the figure adopts an interlocking mechanism for engaging the paper-pressing guides 52 in the roller support member when the guides 52 shift upward by a predetermined amount or more, and moving the take-in roller 38 upward integrally. The structure will be described.

As described above, the take-in roller 38 (bracket 44) and paper-pressing guides 52 to the left and right of the roller 38 are supported rotatably on the rotating shaft 31*x*. Then, when the paper-pressing guides 52 rotate a predetermined angle or more, the bracket 44 of the take-in roller is coupled to move upward in the same direction by the same amount.

As shown in FIG. 4, interlocking pieces 53 protruding toward the left and right paper-pressing guide sides are integrally formed in the bracket 44. The right-side paper-pressing guide 52*a* engages in the interlocking piece 53*a*, and similarly, the left-side paper-pressing guide 52*b* engages in the interlocking piece 53*b*.

When the paper-pressing guides 52 rotate in a counterclockwise direction in FIG. 4, the guides are swung and rotated in the shift direction of the bracket 44 of the take-in roller 38. Then, when a curl occurs in the sheet, the paper-pressing guides 52 are acted upon by the force rotating in the counterclockwise direction in FIG. 4.

Figure 5A:
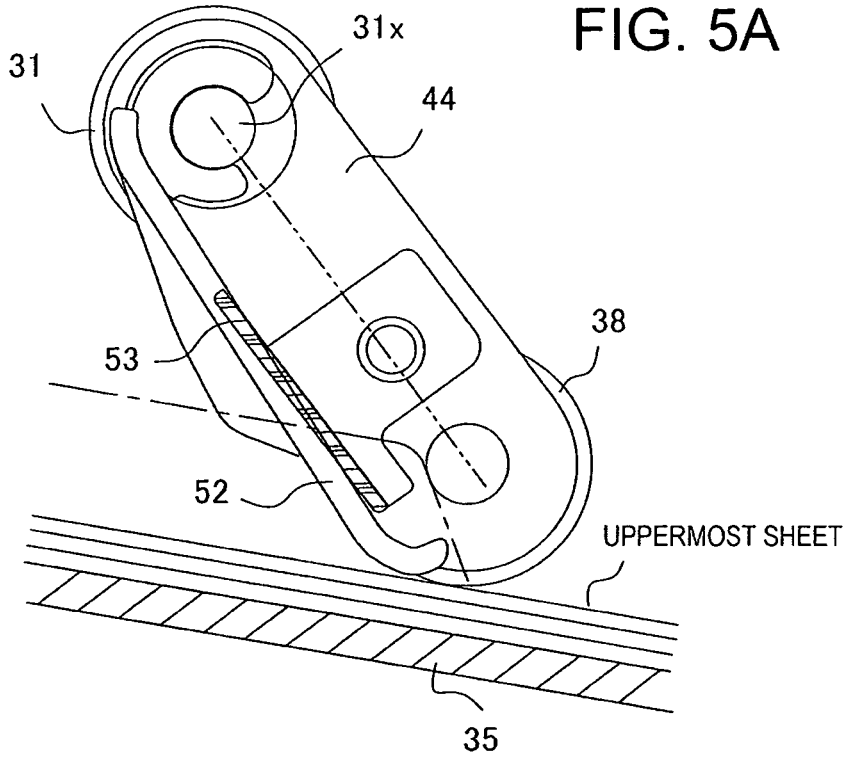
FIGS. 5A and 5B contain explanatory views of operating states of the sheet width-shift mechanism of FIG. 4, where
Figure 5B:
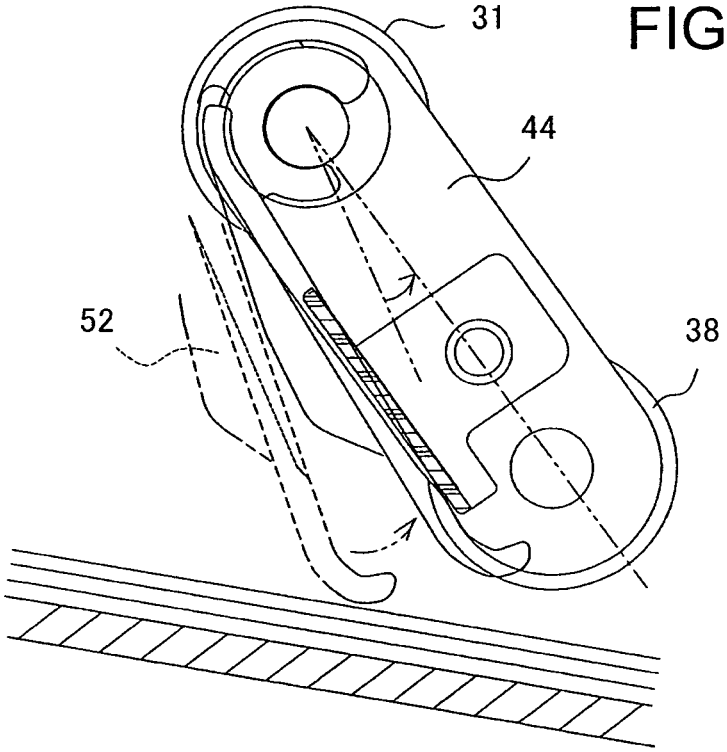

This relationship will be described according to FIGS. 5A-5B. FIG. 5A shows a state in which the sheet is flat, and FIG. 5B shows a state in which a curl occurs in the sheet. When any curl does not occur in the sheet, as shown in FIG. 5A, the take-in roller 38 and paper-pressing guide 52 engage in the uppermost sheet by respective individual motions.

Then, as shown in FIG. 5B, when the width-shift force acts on the sheet side edge by the alignment plate 33, the paper-pressing guide 52 of the dashed-line state in FIG. 5B changes to an angle shown by the solid-line state in FIG. 5B. By the upward change of the paper-pressing guide, the bracket 44 swings the same angle by the action of the interlocking piece 53. By this means, the take-in roller 38 changes the position so as to float upward from the sheet to width-shift and align.

[Configuration of the Punch Unit]

In the sheet carrying-out path 29, the punch unit 27 is disposed in the carry-in portion of the sheet. The structure will be described with reference to FIG. 6B.

The punch unit 27 is comprised of a punch portion 27*a*, die portion 27*b* and waste box 27*c*. In the punch portion 27*a*, a plurality of punch members is axially supported to be able to shift up and down, and shifts up and down by a cam mechanism so as to protrude to the sheet carry-out path 29. Across the path is disposed the die portion 27*b* having punch holes. Further, the waste box 27*c* is disposed below the die portion 27*b*.

Thus configured punch unit 27 is disposed in the entrance portion of the sheet carry-out path 29 (see FIG. 3). A sheet sensor S2 (hereinafter, referred to as an entrance sensor) for detecting the sheet front end and rear end is disposed on the upstream side or downstream side of the punch unit 27.

Then, across the sheet sensor S2, a forward/backward rotating roller 30 is disposed on the downstream side, and a sheet stopper 29*x* is disposed on the upstream side.

Figure 6B:
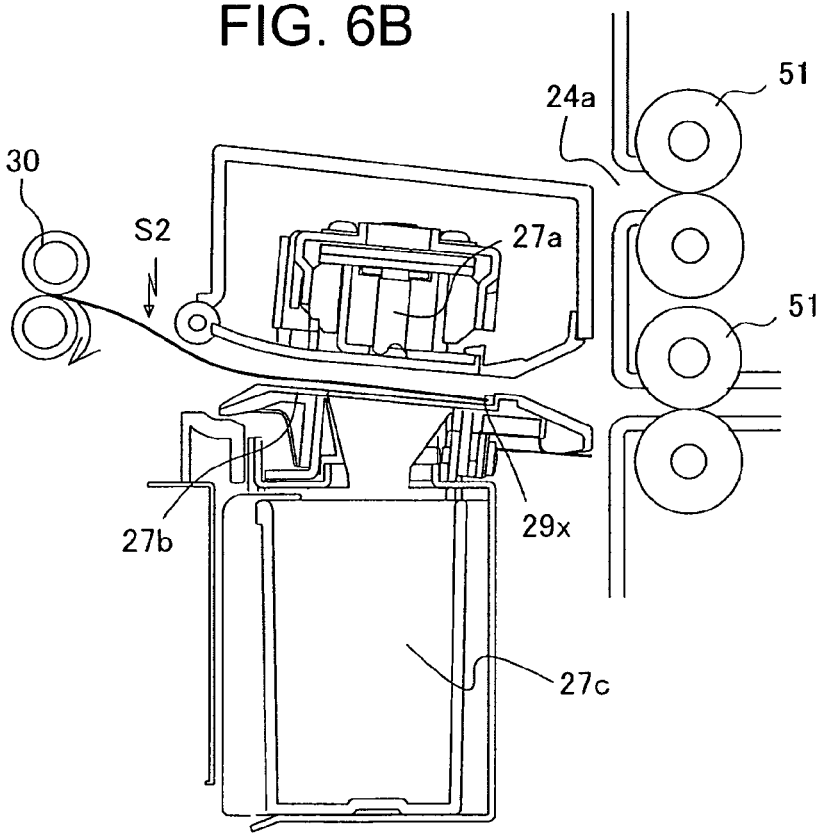

As shown in FIG. 6B, the sheet stopper 29*x*, punch portion 27*a*, sheet sensor S2 and forward/backward rotating roller 30 are disposed in this order to the downstream side along the sheet transport direction, while being sequentially spaced a distance away from one another.

A sheet fed out of the second sheet discharge outlet 24*b* of the image formation apparatus A enters the sheet carry-out path 29, and passes through the punch portion 27*a*, and the sheet rear end passes through the sheet sensor S2. With reference to the passage signal, the forward/backward rotating roller 30 causes the sheet to move forward by rotation in the sheet discharge direction, and after a predetermined time, rotates backward in the sheet-discharge opposite direction.

Then, the sheet moves backward in the sheet-discharge opposite direction, and the rear end strikes the sheet stopper 29*x*. Therefore, the control means halts the forward/backward rotating roller 30 after a predicted time the sheet rear end arrives at the sheet stopper 29*x*. Then, the control means transmits an operation instruction signal to the punch unit 27. Upon receiving the instruction signal, the punch unit 27 executes punching operation, and after finishing the operation, transfers a finish signal to a control section 80 of the post-processing apparatus.

Upon receiving the signal, the control section 80 of the post-processing apparatus rotates the forward/backward rotating roller 30 again in the forward direction to move the sheet to the path downstream side.

[Configuration of the Stack Tray]

Figure 7:
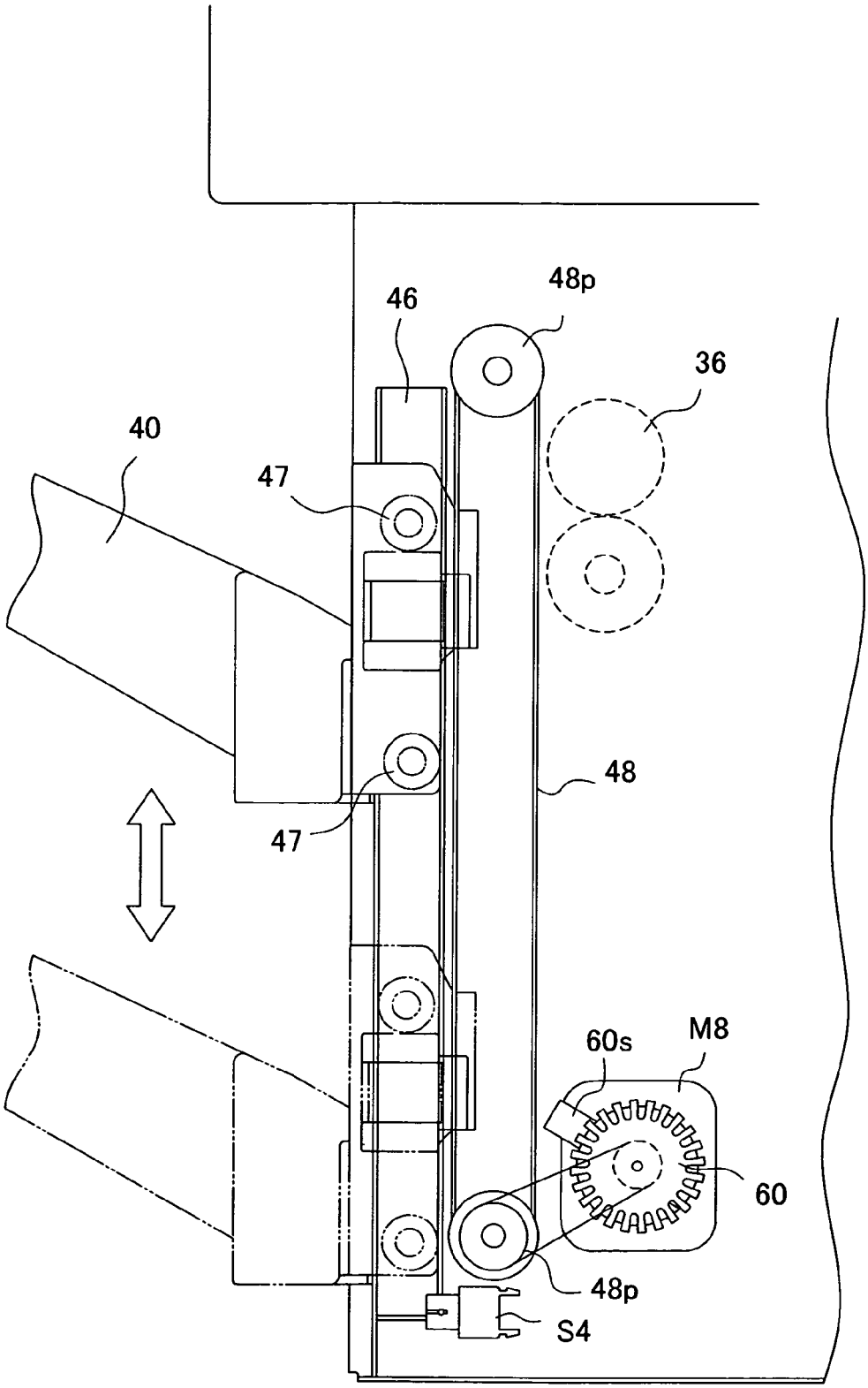
FIG. 7 is an explanatory view of an up-and-down mechanism of a stack tray in the post-processing apparatus of FIG. 2.

The stack tray 40 is provided on the downstream side of the processing tray. The stack tray 90 will be described according to FIG. 7. A guide rail 46 is fixed to a unit frame 10 in the sheet load direction, and the stack tray 40 is fitted and supported by the guide rail 46 to be able to move up and down. "47" shown in the figure denotes a slide roller. The stack tray 40 is fixed to a belt 48 with teeth looped over a pair of upper and lower pulleys 48*p*.

The belt 48 with teeth moves up and down by an up-and-down motor M8 coupled to the pulley 48*p* with teeth. In addition, the motor M8 is provided with an encoder 60 and an encode sensor 60*s*, and controls an up-and-down motion difference of the stack tray 40.

In the stack tray 40, a lower limit sensor S3 and level sensor (not shown) are further disposed. The lower limit sensor S3 detects the lowest position of the tray, and detects a state in which the tray is full of sheets thereon. Meanwhile, the level sensor detects a height position of the uppermost sheet on the tray.

The collection operation of sheets will be described next. Sheets collated and collected on the processing tray are positioned by the position regulating stopper 37, and undergo binding processing by the staple unit 28 disposed in this position. After the binding processing, the sheet bunch on the processing tray is fed out to the stack tray 40 on the downstream side by rotation in the sheet discharge direction of the reverse roller 36 and driven roller 43.

In addition, the invention describes the roller driving method for rotating the reverse roller 36 forward and backward in the same direction as the sheet discharge direction and in the opposite direction, but it is also possible to adopt a driving method for rotating the reverse roller 36 only in the sheet discharge direction. In this case, the take-in roller is preferably comprised of a mechanism of flexible rotating member such as a timing belt.

[Control Configuration]

Figure 8:
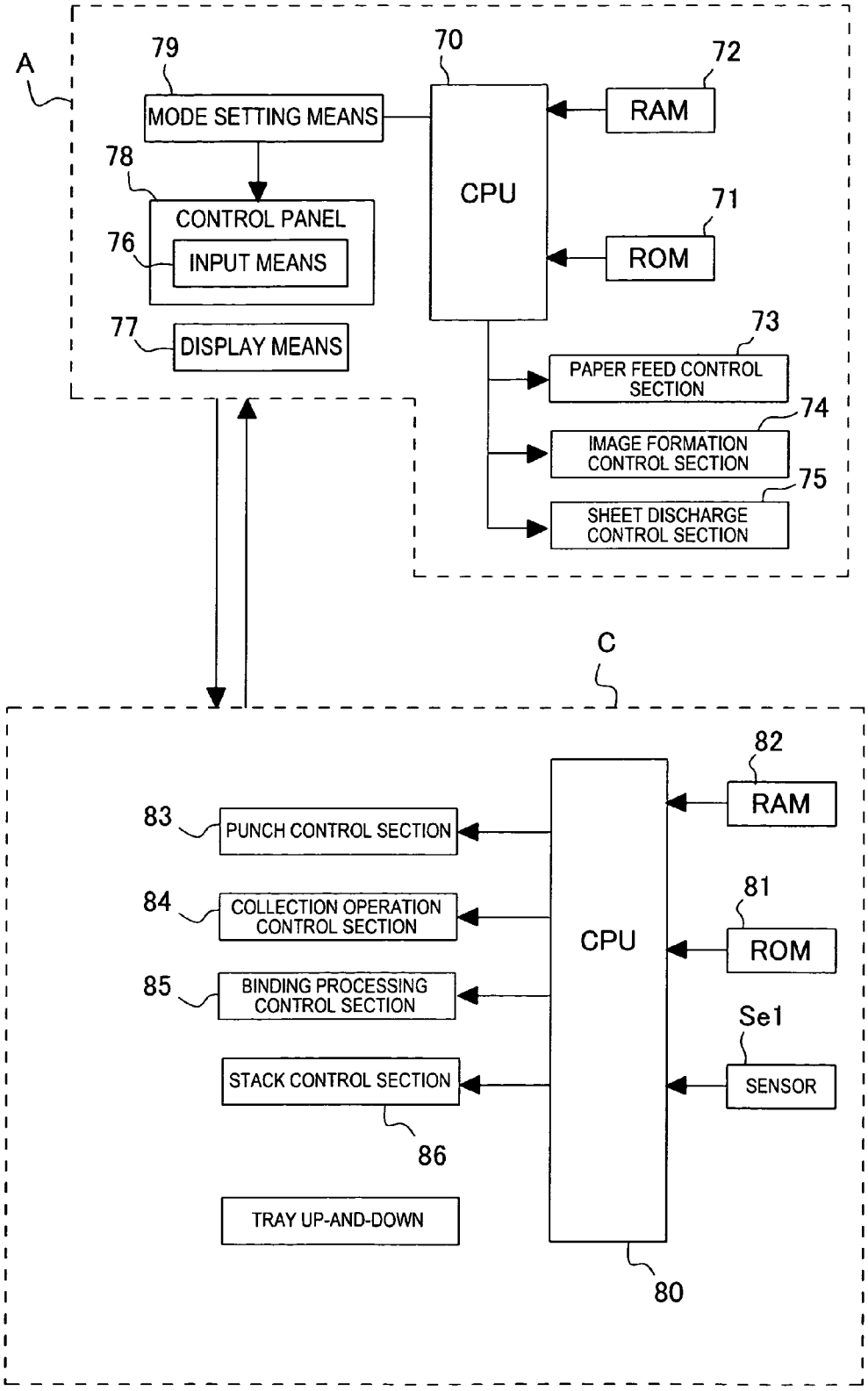
FIG. 8 is a block diagram of a control section in the post-processing apparatus of FIG. 2.
Figure 9:
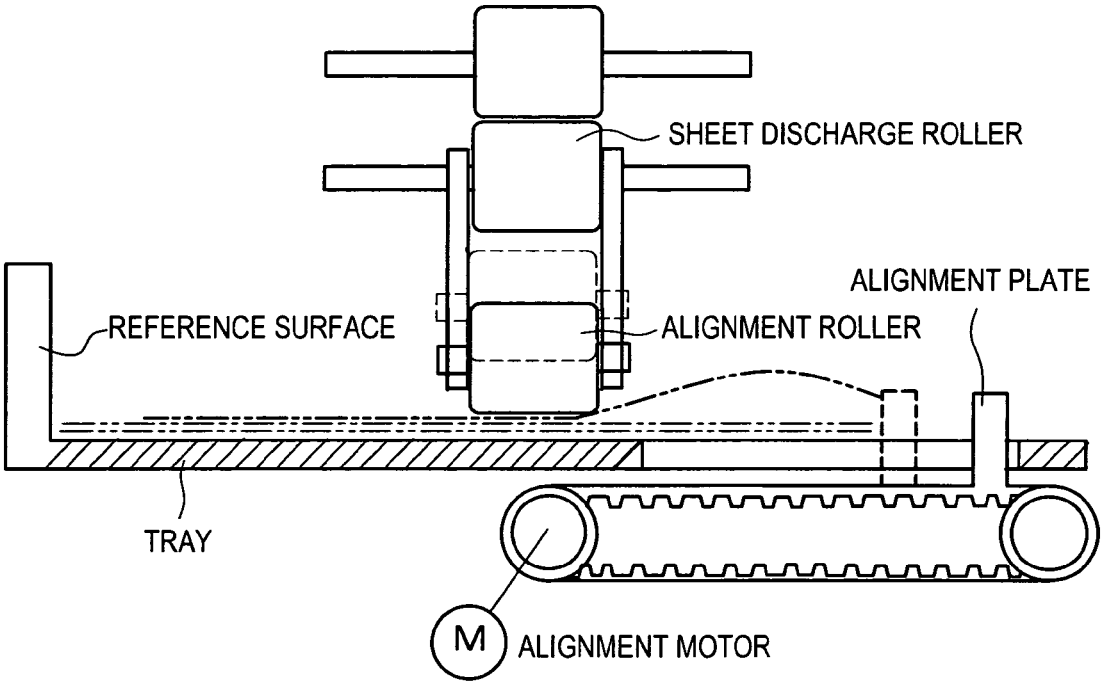
FIG. 9 is an explanatory view of conventional techniques.

A control configuration of the image formation system as shown in FIG. 2 will be described according to FIG. 8. The image formation apparatus A is provided with a control CPU 70, and the control CPU 70 is connected to ROM 71 for storing operation programs, and RAM 72 for storing control data. Then, the control CPU 70 is provided with a paper feed control section 73, image formation control section 74, and sheet discharge control section 75.

Concurrently therewith, the control CPU 70 is connected to display means 77 and a control panel 78 provided with input means 76.

Further, the control CPU 70 is configured to select a "printout mode" and a "post-processing mode". In the "printout mode", the sheet with the image formed is stored in the stack tray 40 without performing any finish processing.

Meanwhile, in the "post-processing mode", sheets with the image formed are collated and collected, and stored in the stack tray 40 after performing binding processing. The sheet storage apparatus B according to the invention is built into the post-processing apparatus C.

The post-processing apparatus C is provided with a post-processing control CPU 80, and the CPU 80 is connected to ROM 81 for storing operation programs, and RAM 82 for storing control data. Then, the control section of the image formation apparatus A transfers, to the control CPU 80, sheet size information, sheet discharge instruction signal, and a mode setting command for the post-processing mode and the printout mode.

The control CPU 80 is provided with a punch control section 83 that performs punching processing on the sheet with the image formed, a collection operation control section 84 that collates and collects sheets on the processing tray 35, a binding processing control section 85, and a stack control section 86.

[Operation Explanation]

The control CPU 70 of the image formation apparatus A executes the following image formation operation according to the image formation program stored in the ROM 71. Similarly, the control CPU 80 of the post-processing apparatus C executes the following post-processing operation according to the post-processing program stored in the ROM 81.

[Image Formation Operation]

When a "one-side printing mode" is selected, the control CPU 70 picks a sheet of a set size from the paper feed section 11 to feed to the register roller 16. Around the time of feeding, the control CPU 70 forms an image on the transfer belt 21 according to predetermined image data.

The image data is stored in a data storage section, not shown, or is transferred from an outside apparatus coupled to the image apparatus A.

Then, the control CPU 70 transfers a toner image formed on the transfer belt 21 to the sheet, which is fed from the register roller 16, in the transfer section 20, and fuses the image in the fuser 23 on the downstream side. Subsequently, the control CPU 70 feeds the sheet with the image formed to the sheet discharge path 22 to transfer to the post-processing apparatus C, described later.

Further, when a "two-side printing mode" is selected, the control CPU 70 executes the above-mentioned operation to form an image on one side of the sheet, and feeds the sheet to the sheet discharge path 22. At this point, the control CPU 70 causes the post-processing apparatus C to execute the following operation.

The control CPU 80 of the post-processing apparatus C feeds the sheet, which is fed to the sheet discharge path 22 with a detection signal of the sensor such that the sheet front end arrives at the sheet discharge path 22, from the sheet discharge path 22 to the sheet carrying-out path 29.

Concurrently with the path switching control, when the sheet front end is carried in the processing tray 35 from the carrying-out path 29, the control CPU 80 shifts the reverse roller 36 from the waiting position to the actuation position, and at the same time, rotates the roller. Then, the sheet carried in the processing tray 35 is fed to the downstream side along the processing tray 35 by rotation of the reverse roller 36.

Next, when the control CPU 80 detects the sheet rear end by the sensor S1, at timing at which the sheet rear end passes through a guide flapper, the control CPU 80 rotates backward the sheet discharge roller 31 of the sheet carrying-out path 29. Then, the sheet reverses the transport direction, and moves backward (switchback-shifts) to the sheet discharge path 22. By this switchback shift, the sheet is fed to a reverse path 50.

Then, the control CPU 70 of the image formation apparatus A reverses the side of the sheet fed to the reverse path 50 in this path to feed to the register roller 16. Around the time of feeding, the control CPU 70 forms a backside image on the transfer belt 21, forms the image on the backside of the sheet in the transfer section 20, and carries out the sheet to the sheet discharge path 22.

The invention claimed is:

1. A sheet storage apparatus comprising:

a placement tray to load a sheet fed from a sheet discharge outlet;

a take-in rotating body disposed on the placement tray to guide the sheet fed from the sheet discharge outlet to a predetermined position on the tray;

a support member that supports the take-in rotating body swingably to engage in an uppermost sheet;

alignment means for width-shifting and aligning the sheet fed in by the take-in rotating body in a sheet-discharge orthogonal direction; and a paper-pressing guide having a paper-pressing surface for pressing a top surface of the sheet on the placement tray, wherein the paper-pressing guide is supported by an apparatus frame swingably so as to float upward from the sheet corresponding to a curl of the sheet on the placement tray, and when the paper-pressing surface floats a predetermined amount or more from the top surface of the sheet on the placement tray, the paper-pressing guide engages in the support member to move upward integrally with the take-in rotating body.

2. The sheet storage apparatus according to claim 1, wherein the paper-pressing guide and the take-in rotating body are supported by the apparatus frame to be able to move up and down independently of each other corresponding to a load amount of sheets on the placement tray, and when a height position of the paper-pressing guide rises while exceeding a height position of the take-in rotating body by a predetermined amount or more, the paper-pressing guide moves upward integrally with the take-in rotating body.

3. The sheet storage apparatus according to claim 2, wherein the placement tray is provided with a sheet regulating member, in a predetermined position positioned on the downstream side of the take-in rotating body, to strike an end of the sheet to regulate, the alignment means is provided with an alignment member for width-shifting and aligning the sheet regulated by the sheet regulating member to a reference position, and in the paper-pressing guide, the paper-pressing surface for preventing the sheet from becoming distorted and deformed is disposed between the take-in rotating body and the alignment member.

4. The sheet storage apparatus according to claim 3, wherein the alignment means is comprised of a pair of left and right alignment plates disposed on the placement tray to be movable in the sheet-discharge orthogonal direction, an alignment motor for causing the pair of alignment plates to reciprocate between separate waiting positions and approaching actuation positions, and control means for controlling the alignment motor, and after the take-in rotating body is driven and rotated to carry the sheet to the sheet regulating member, the control means actuates the alignment motor to position the sheet in a predetermined position using the pair of left and right alignment plates.

5. The sheet storage apparatus according to claim 1, wherein the placement tray is provided with a sheet regulating member, in a predetermined position positioned on the downstream side of the take-in rotating body, to strike an end of the sheet to regulate, the alignment means is provided with an alignment member for width-shifting and aligning the sheet regulated by the sheet regulating member to a reference position, and in the paper-pressing guide, the paper-pressing surface for preventing the sheet from becoming distorted and deformed is disposed between the take-in rotating body and the alignment member.

6. The sheet storage apparatus according to claim 5, wherein the alignment means is comprised of a pair of left and right alignment plates disposed on the placement tray to be movable in the sheet-discharge orthogonal direction, an alignment motor for causing the pair of alignment plates to reciprocate between separate waiting positions and approaching actuation positions, and control means for controlling the alignment motor, and after the take-in rotating body is driven and rotated to carry the sheet to the sheet regulating member, the control means actuates the alignment motor to position the sheet in a predetermined position using the pair of left and right alignment plates.

7. The sheet storage apparatus according to claim 1, wherein a stack tray is disposed on the downstream side of the placement tray, and it is configured to load sheets fed from the sheet discharge outlet on the placement tray to perform post-processing, and then, to store the sheets subjected to the processing on the stack tray.

8. An image formation system comprising:

an image formation section that forms an image on a sheet; and a post-processing section that collates and collects sheets from the image formation section to perform post-processing, wherein the post-processing section is provided with a configuration according to claim 1.

* * * * *